US010543512B2

(12) United States Patent
Frazier

(10) Patent No.: US 10,543,512 B2
(45) Date of Patent: Jan. 28, 2020

(54) APPARATUS AND METHOD OF SEPARATION WITH A PRESSURE DIFFERENTIAL DEVICE

(71) Applicant: M-I L.L.C., Houston, TX (US)

(72) Inventor: Evan Frazier, Covington, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 15/781,701

(22) PCT Filed: Dec. 7, 2016

(86) PCT No.: PCT/US2016/065234
§ 371 (c)(1),
(2) Date: Jun. 6, 2018

(87) PCT Pub. No.: WO2017/100226
PCT Pub. Date: Jun. 15, 2017

(65) Prior Publication Data

US 2018/0353997 A1 Dec. 13, 2018

Related U.S. Application Data

(60) Provisional application No. 62/264,412, filed on Dec. 8, 2015.

(51) Int. Cl.
*B07B 4/08* (2006.01)
*B03B 4/02* (2006.01)
(Continued)

(52) U.S. Cl.
CPC ..... *B07B 4/08* (2013.01); *B03B 4/02* (2013.01); *E21B 21/065* (2013.01); *B07B 1/28* (2013.01);
(Continued)

(58) Field of Classification Search
CPC .... B03B 4/02; B07B 1/28; B07B 1/42; B07B 4/00; B07B 4/08; B07B 2230/01; E21B 21/065
See application file for complete search history.

(56) References Cited

U.S. PATENT DOCUMENTS

2008/0078699 A1 4/2008 Carr
2009/0301939 A1 12/2009 Sorensen
(Continued)

FOREIGN PATENT DOCUMENTS

JP H01-148315 A 6/1989
WO 1990/13347 A1 11/1990

OTHER PUBLICATIONS

International Preliminary Report on Patentability for the equivalent International patent application PCT/US2016/065234 dated Jun. 21, 2018.

(Continued)

*Primary Examiner* — Joseph C Rodriguez
*Assistant Examiner* — Kalyanavenkateshware Kumar
(74) *Attorney, Agent, or Firm* — Jeffrey D. Frantz

(57) ABSTRACT

A device and system applicable to separating components of a slurry is disclosed. The slurry can be a mixture of drilling fluid and drilling cuttings that can be separated with a separatory screen. A separatory tray can be disposed below an underside of the separatory screen. A pressure differential pan can provide fluid flow to a sump. A pressure differential generator can be located within the pressure differential pan and create a pressure differential between an upper side and a lower side of the separatory screen to enhance the flow of drilling fluid through the separatory screen.

17 Claims, 5 Drawing Sheets

(51) Int. Cl.

| | |
|---|---|
| ***E21B 21/06*** | (2006.01) |
| *B07B 4/00* | (2006.01) |
| *B07B 1/28* | (2006.01) |
| *B07B 1/42* | (2006.01) |

(52) U.S. Cl.
CPC . *B07B 1/42* (2013.01); *B07B 4/00* (2013.01); *B07B 2230/01* (2013.01)

(56) References Cited

U.S. PATENT DOCUMENTS

| | | | | |
|---|---|---|---|---|
| 2012/0279932 | A1* | 11/2012 | Pomerleau ..... | B01D 29/117<br>210/785 |
| 2015/0048037 | A1 | 2/2015 | Frazier et al. | |

OTHER PUBLICATIONS

International Search Report and Written Opinion for the equivalent International patent application PCT/US2016/065234 dated Mar. 13, 2017.

* cited by examiner

APPARATUS AND METHOD OF SEPARATION WITH A PRESSURE DIFFERENTIAL DEVICE

CROSS-REFERENCE TO RELATED APPLICATION

This application claims priority to and the benefit of a U.S. Provisional Application having Ser. No. 62/264,412, Dec. 8, 2015, which is incorporated by reference herein.

BACKGROUND

Vibratory separators are used to separate solid particulates of different sizes and/or to separate solid particulate from fluids. Various industries use vibratory separators for filtering materials, for example, the oil and gas industry, the food processing industry, the pharmaceutical industry, and the agriculture industry. A vibratory separator is a vibrating sieve-like table upon which solids-laden fluid is deposited and through which clean fluid emerges. The vibratory separator may be a table with a generally perforated filter screen bottom. Fluid is deposited at the feed end of the vibratory separator. As the fluid travels down the length of the vibrating table, the fluid falls through the perforations to a reservoir below, leaving the solid particulate material behind. The vibrating action of the vibratory separator table conveys solid particles left behind to a discharge end of the separator table.

To facilitate or improve the rate and efficiency at which a separator removes liquids from solids, a pressure differential may be developed or applied across a screen disposed in the separator. The pressure differential may be applied by a pressure differential device internal or external to the separator that applies a pressure differential across the screen to pull both liquids and vapor or air through the screen. For example, the pressure differential device may be a vacuum generating device.

DETAILED DESCRIPTION

Figure 1:
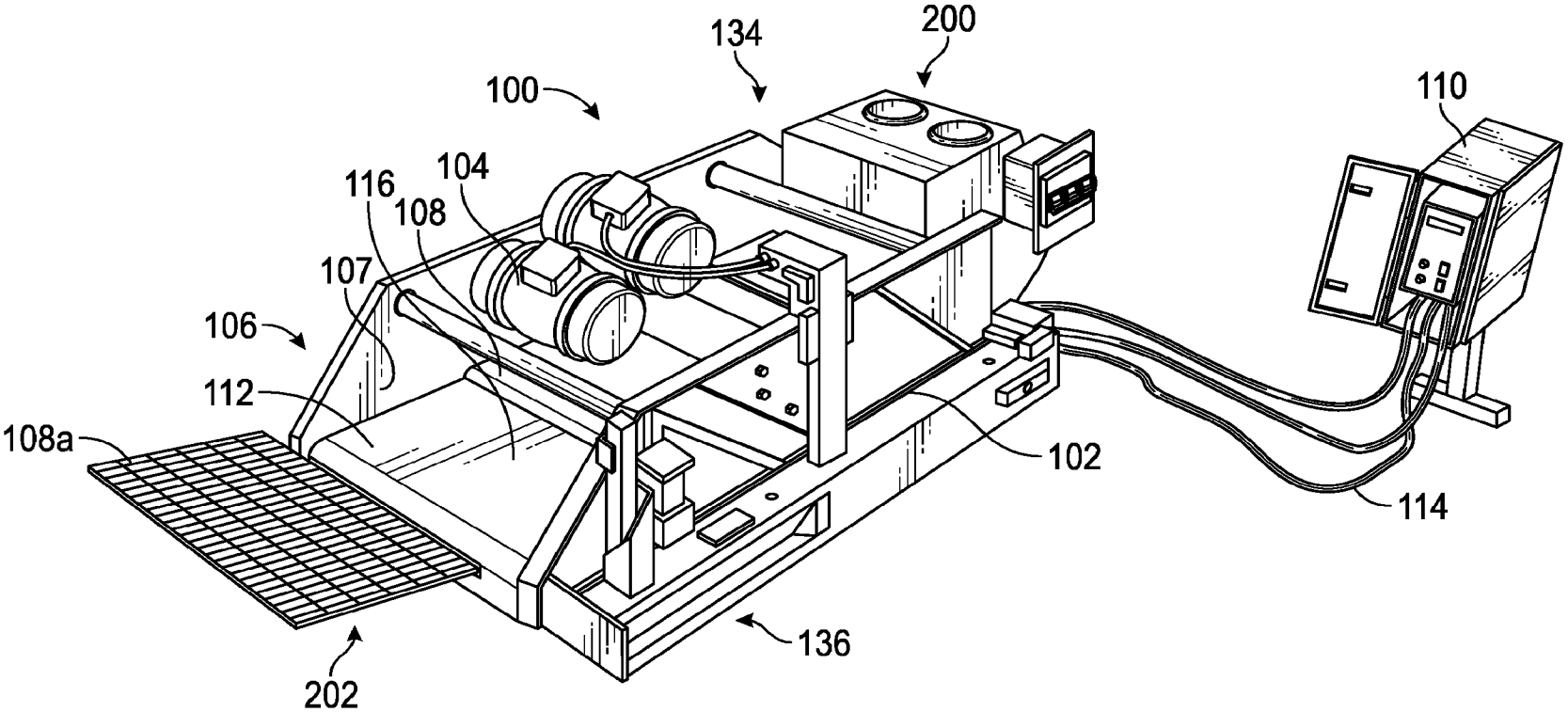
FIG. 1 is a perspective view of a vibratory separator in accordance with embodiments disclosed herein.

In the following detailed description, reference is made to the accompanying drawings. In the drawings, similar symbols or identifiers typically identify similar components, unless context dictates otherwise. The illustrative embodiments described herein are not meant to be limiting. Other embodiments may be utilized, and other changes may be made, without departing from the scope of the subject matter presented here. It will be readily understood that aspects of the present disclosure, as generally described herein, and illustrated in the Figures, may be arranged, substituted, combined, and designed in a wide variety of different configurations, all of which are explicitly contemplated and make part of this disclosure.

Embodiments disclosed herein relate to an apparatus and method for providing a pressure differential across a screen in a vibratory separator. More specifically, embodiments disclosed herein relate to an apparatus and method for coupling a pressure differential device to a vibratory separator. In accordance with embodiments disclosed herein, a pressure differential pan is secured in or to a tray below a screen of a vibratory separator to fluidly couple a pressure differential device to the vibratory separator to provide a pressure differential across a screen of the vibratory separator. In some embodiments, a flowline may be coupled between the pressure differential pan and a sump, pit, receptacle, or the like. The pressure differential pan includes structure to couple the flowline thereto so that a pressure differential may be provided across a screen of a vibratory separator. In some embodiments, the pressure differential pan may be coupled to a hose assembly, wherein the hose assembly is coupled to the sump. The pressure differential pan includes structure to couple a pressure differential device thereto so that a pressure differential created proximate the flowline coupling may be provided across a screen of a vibratory separator.

Vibratory separators may be used in various industries such as the food industry, cleaning industry, oil and gas industry, waste water treatment, and others. A vibratory separator may include a single deck, two decks, three decks, or more. Each deck may include one, two, or more screens. As shown in FIG. 1, for example, a vibratory separator 100 includes a basket 102, one or more motors 104 for imparting vibratory motion to the basket 102, and at least one deck 106 having at least one screen 108. Each screen 108 may include a screen frame defining a plurality of openings or slots and a screen mesh disposed thereon for separating particulate matter larger than a size of openings or perforations of the screen mesh. A vibratory separator may also include a pressure differential system including equipment for providing a pressure differential across one or more of the screens 108. The pressure differential system may include a pressure differential generating device (also referred to herein as a pressure differential device), a pan, tray, or sump located below a screen across which the pressure differential is provided, and a flowline to fluidly couple the pressure differential device and the pan. As described in more detail below, the pressure differential system may also include a pressure differential pan coupled to the tray below a screen of a vibratory separator, thereby providing support and structural rigidity to the tray. The pressure differential device is coupled to the pressure differential pan, so as to provide a pressure differential across the screen.

The pressure differential device may include a timer box that supplies air to a device, such as an air knife, air eductor or line vacuum, which may then create a vacuum under the screen by forcing air through small nozzles and inducing a pressure drop. In this embodiment, a flowline may be coupled to an air or gas source and the timer box and to a hose assembly coupled to the pressure differential pan. An air knife may be installed proximate a drain port located on the bottom of the tray, such that when air is forced through the air knife (e.g., forcing air through one or more small nozzles in the air knife which is located in the pressure differential pan and proximate the drain port located on the bottom of the tray) a pressure drop is induced which creates the pressure differential across the screen (e.g., a vacuum under the screen). In one or more embodiments, the pressure differential device may include a rig vacuum system and/or fluid eductor/jet nozzle arrangement to provide a pressure differential across the screen. In the embodiment in which the pressure differential device may include a vacuum system, a flowline may be coupled to the vacuum system and coupled to the pressure differential pan, such that the flowline may pull both air/vapors and liquid (e.g., drilling fluid) through the screen.

For example, as shown in FIG. 1, a pressure differential device 110 external to the vibratory separator 100 provides a pressure differential to one or more screens 108 disposed in the vibratory separator 100. The vibratory separator 100 may have an inlet end (or feed end) 200 for receiving a slurry of cuttings and wellbore fluid and an outlet end (or discharge end) 202. Wellbore fluid as used herein shall refer to hydrocarbons, drilling fluid, lost circulation material or other fluids or substances present in the wellbore. The slurry of cuttings (solids) and drilling fluid may enter the inlet end 200 of the vibratory separator 100 and pass over the screens 108. The slurry may be conveyed within the vibratory separator 100 toward the outlet end 202. The vibratory motion imparted by the motors 104 may aid in conveying the slurry through the vibratory separator 100. Liquids, such as drilling fluid, from the separation process of the vibratory separator 100 may be collected in a sump (not shown) located at the lower part of the vibratory separator 100.

The vibratory separator 100 may have a pan or tray 112 located below the screen 108. The tray 112 may act as a capture device for wellbore fluid of the slurry that passes through the screen 108. As shown, the tray 112 may be generally rectangular in shape. However, the tray 112 may be any shape and size to operate within or attach to the vibratory separator 100. The tray 112 may be formed of metal, composite, or other materials as will be appreciated by a person having ordinary skill in the art. The tray 112 may be molded as a unitary component or formed from multiple components attached or otherwise secured together. The tray 112 may be stamped into a desired shape and/or formed using any known fabrication technique. The tray 112 may be configured to receive the screen 108, for example, as shown in FIG. 1. The screen 112 may be generally rectangular in shape. Screen wedges 171 may be used to secure the screen 108 and/or the tray 112 within the vibratory separator 100.

Figure 2:
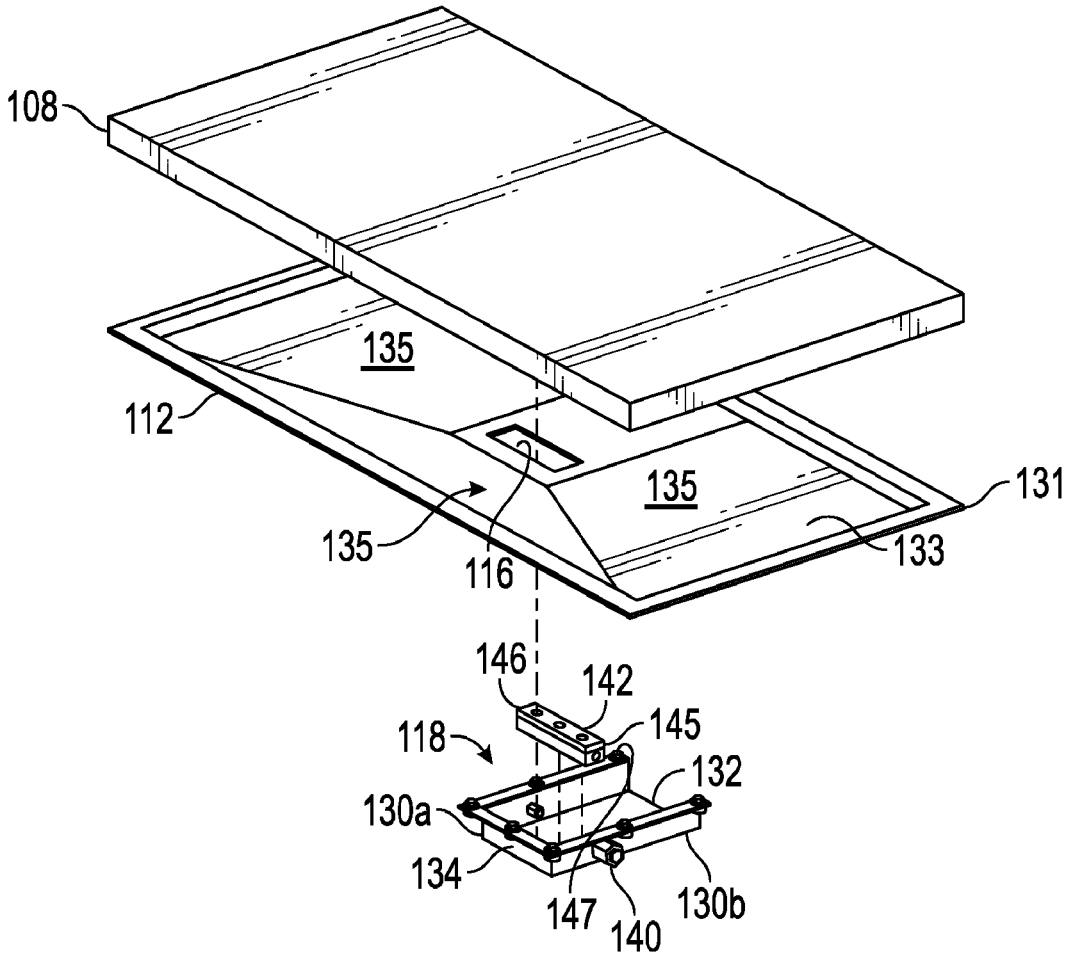
FIG. 2 is an exploded view of a screen assembly for use in a vibratory separator in accordance with embodiments disclosed herein.

As shown in FIG. 2, the tray 112 may have a lip 131 located on peripheral edges of the tray 112. Thus, the lip 131 may extend about the periphery of the tray 112. The lip 131 may be located in a position above an interior area 33 of the tray 112. The lip 131 may define the interior area 133 of the tray 112. The interior area 133 of the tray 112 may have surfaces 135 that angle away from the lip 131 and downward with respect to the lip 131 toward a location inside a periphery defined by the peripheral edges of the tray 112. The surfaces 135 may force or direct the wellbore fluid passing through the screen 108 into a drain port 116. While the drain port 116 is illustrated as rectangular, the drain port 116 may be any shape, such as but not limited to circular, elliptical, helical, octagonal, hexagonal, and/or any desired shape.

Referring to FIGS. 1 and 2 together, the pressure differential device 110 is fluidly coupled to the tray 112 via a flowline 114. In the embodiment shown, the pressure differential device 110 includes a timer box and an air or gas source (not shown) that provides air or gas through the flowline 114 to a hose assembly (not shown) coupled to tray 112. As shown in FIG. 1, the tray 112 is disposed in the basket 102 below a first screen 108*a* (the first screen 108*a* being shown removed from the basket). The tray 112 includes drain port 116 through which the pressure differential may be applied to the screen 108. For example, pressure differential device 110 may provide suction below the screen 108 to pull liquids and vapor or air through the screen 108. The location of the drain port 116 in the tray 112 may be proximate a feed end or a discharge end of the tray 112 or the drain port 116 may be centrally located in the tray 112. The location of the drain port 116 may be offset from a central location of the tray 112 such that the drain port 116 is closer to a left side or a right side of the screen 108. The surfaces 135 of the tray 112 may be angled or sloped from sides of the tray 112 down toward the drain port 116 to facilitate removal of any liquids pulled through the screen 108.

The screen 108 may fit and/or seal with the lip 131 of the tray 112. Thus, the screen 108 may form a substantially air-tight and/or fluid-tight seal with the tray 112. The screen 108 may cover and/or may enclose the interior area 133 of the tray 112. The interior area 133 may receive fluid which has passed through the screen 108. The interior area 133 and/or surfaces 135 may be sloped such that the liquid is substantially directed toward the drain port 116. In this manner, the liquid, with the assistance of one or more forces (e.g., gravity, manmade forces, pressure differential), may contact the interior area 133 and flow toward the drain port 116, wherever located.

Figure 3:
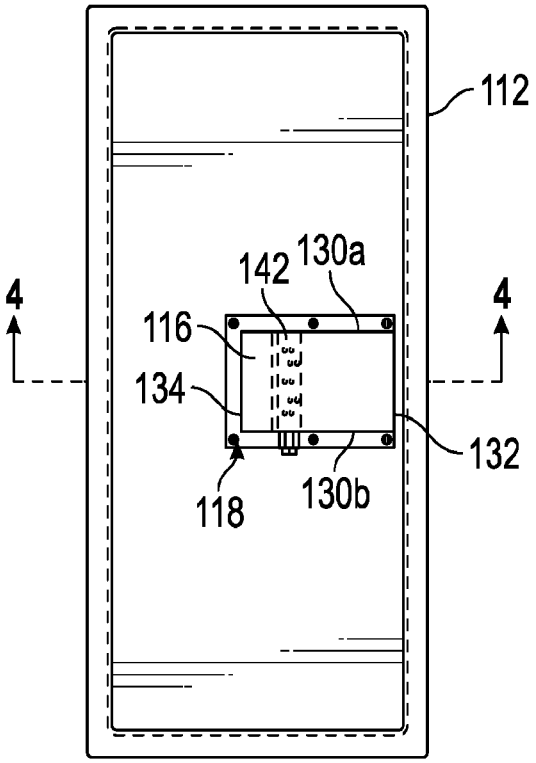
FIG. 3 is a top view of the screen assembly of FIG. 2, with screen removed, in accordance with embodiments disclosed herein.
Figure 4:
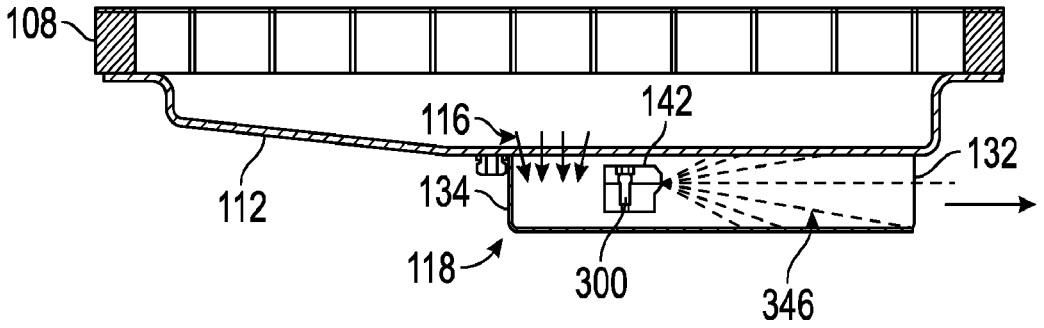
FIG. 4 is a cross-sectional view taken along line A-A of FIG. 3.
Figure 5:
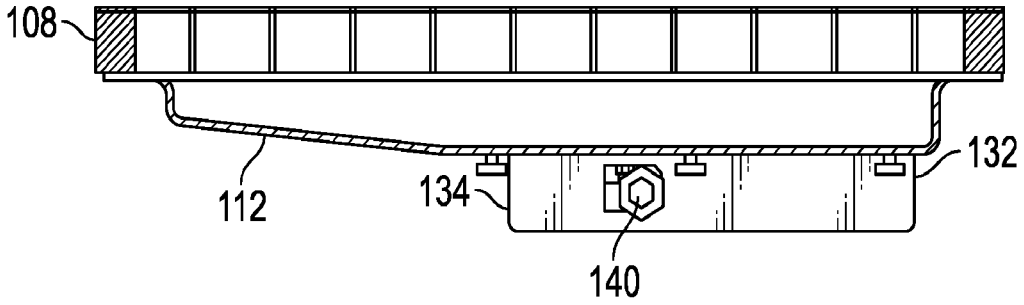
FIG. 5 is a side view of the screen assembly of FIG. 4 for use in a vibratory separator in accordance with embodiments disclosed herein.

A pressure differential pan 118, as shown in FIGS. 2 through 4, may be used to fluidly couple the tray 112 to a pressure differential generating device, such as the pressure differential device 110 (FIG. 1). The pressure differential pan 118 may have two side regions 130*a* and 130*b*, opposite each other, the side regions 130*a,b* having an end region 132 therebetween. The end region 132 may be open to a sump (not shown) of the vibratory separator 100. An end region opposite end region 132 is a front region 134 also between the two side regions 130*a* and 130*b*. A top surface of the side regions 130*a,b* and the front region 134 may be coupled to the tray 112. The top surface of the side regions 130*a,b* and the front region 134 may be coupled to the tray 112 using any method or apparatus known in the art, for example, welding, couplers, a mechanical fastener, adhesive, etc. The drain port 116 of the tray 112 may be located within the perimeter (defined by the side regions 130*a,b* and opposite end regions 132, 134) of the pressure differential pan 118. In other words, the drain port 116 of the tray 112 may be aligned between the side regions 130*a,b* and also between the opposite end regions 132, 134, thus providing a flowpath for the fluid from the tray 112 to flow to the sump (not shown). In some examples, gasket(s) (not shown) may be molded with or into and/or fused with lip 131 of the tray 112, either on the top and/or bottom of the lip 131.

In some embodiments, in addition to the vibratory motion, a pressure differential may be applied to the tray 112. As discussed above, the pressure differential may be applied to the tray 112 using an external pressure differential generating device, an internal pressure differential generating device, or a combination of internal and external pressure differential generating devices. In one or more embodiments, a pressure differential generator 142 may be coupled to the pressure differential pan 118. The pressure differential generator 142 may have a first end 145 and a second end 146. The pressure differential generator 142 includes a fluid inlet 147. The fluid inlet 147 may be connected to an external pressure differential device, such as pressure differential device 110 (FIG. 1) via an inlet 140 located on a side of the pressure differential pan 118, for example on the side region 130*a* of the pressure differential pan 118, and the flowline 114 (FIG. 1). In some embodiments, a vacuum may be pulled through the screen 108 by the pressure differential device 110. In other embodiments, a fluid may be supplied to the pressure differential generator 142 which may create a vacuum by the fluid flowing through the pressure differential generator 142. The fluid may be clean or unclean drilling fluid, air, a gas, water, or any other fluid that may be desired based on the use of the separator 100. In the event that the fluid is air, the pressure differential device 110 may include a source, such as an air compressor and/or the like. The fluid (i.e., liquids/solids mixture) to be separated, may be deposited on the screen 108 in the separator 100. The pressure differential generator 142 creates or amplifies a pressure differential applied across the screen 108 and may pull or draw liquid from the liquid/solids mixture along with surrounding air and/or vapor through the screen 108. As a result, the liquid and surrounding air/vapor may be pulled through the screen 108 and into the interior area 133 of the tray 112 at a greater rate and/or volume than possible without the applied pressure differential. One of ordinary skill in the art will appreciate that solids or particulate matter smaller than openings in the screen may also be pulled through the screen with the liquid and air and/or vapor. The liquid and air that has passed through the screen 108 may then exit the drain port 116 of the tray 112. In some embodiments, the tray 112 and the pressure differential generator 142 may be integrally formed with the screen 108. The tray 112, the pressure differential pan 118, the pressure differential generator 142, and the screen 108 may be molded together or may be constructed separately and coupled (e.g., fused, mechanically fastened, etc.) together. The pressure differential generator 142 may be positioned anywhere within the perimeter of the tray 112 and/or the screen 108.

One of ordinary skill in the art will appreciate that pressure differential systems in accordance with embodiments disclosed herein may be configured to be secured to various configurations of the tray 112 of a vibratory separator. For example, size, shape, bolt hole configuration, recessed regions, etc. of the tray 112 may be varied in order to accommodate the size, shape, and/or configuration of the pressure differential generator 142 and the pressure differential pan 118 so that the pressure differential generator 142 may be securely coupled to the tray 112 and/or pressure differential pan 118. FIGS. 2-5 show an example of a pressure differential system for a vibratory separator wherein a pressure differential device is installed in a pressure differential pan 118.

With reference to FIGS. 1-5, in one or more embodiments, the pressure differential generator 142 may be coupled to the pressure differential pan 118 proximate the drain port 116 of the tray 112. The pressure differential generator 142 may be an air educator, such that fluid flow through the pressure differential generator 142 creates suction below the screen 108 to pull liquid and air/vapor through the screen. The pressure differential generator 142 may provide a substantially uniform flow of air across the length of the pressure differential generator 142. The pressure differential generator 142 may traverse the width of the pressure differential pan 118 and be coupled to the side regions 130*a*/130*b*. The pressure differential generator 142 may be coupled to the pressure differential pan 118 using any method or apparatus known in the art, for example, welding, couplers, a mechanical fastener, adhesive, etc. The pressure differential generator 142 may be located within the pressure differential pan 118, such that, liquid and air pulled through the screen flows around the pressure differential generator 142, not through the pressure differential generator 142. The pressure differential generator 142 is supplied fluid, such as a gas (e.g., air, nitrogen, etc.) through the inlet 140 coupled to flowline 114 on the side region 130*a* of the pressure differential pan 118. While shown coupled to the side region 130*a*, the flowline 114 may be fluidly coupled to the pressure differential pan 118 through an inlet 140 on the side region 130*b* or end region 134. The fluid, e.g., air, supplied by the fluid source exits the pressure differential generator 142 via a nozzle (not shown), forming a uniform sheet of air across the entire length of the pressure differential generator 142. The exiting air entrains the fluid from the tray 112 and creates a pressure differential across screen 108, e.g., applies suction to the screen 108.

The pressure differential pan 118 is configured to be secured to the tray 112. The pressure differential pan 118 may provide structural support and/or rigidity to the tray 112 when installed so as to prevent wear and/or cracking of the tray 112. When the pressure differential pan 118 is installed, the flowline 114 is coupled to the pressure differential pan 118 which is coupled to the bottom of the tray 112. As shown, the pressure differential pan 118 may be aligned to encompass the drain port 116 of the tray 112 and configured to receive the flowline 114. The flowline 114 may be coupled to the inlet 140 of the pressure differential pan 118. The flowline 114 may be coupled to the inlet 140 of the pressure differential pan 118 using any method or apparatus known in the art, for example, threaded coupling, a mechanical fastener, adhesive, etc. The inlet 140 may include a coupling configured to receive the flowline 114.

Figure 6:
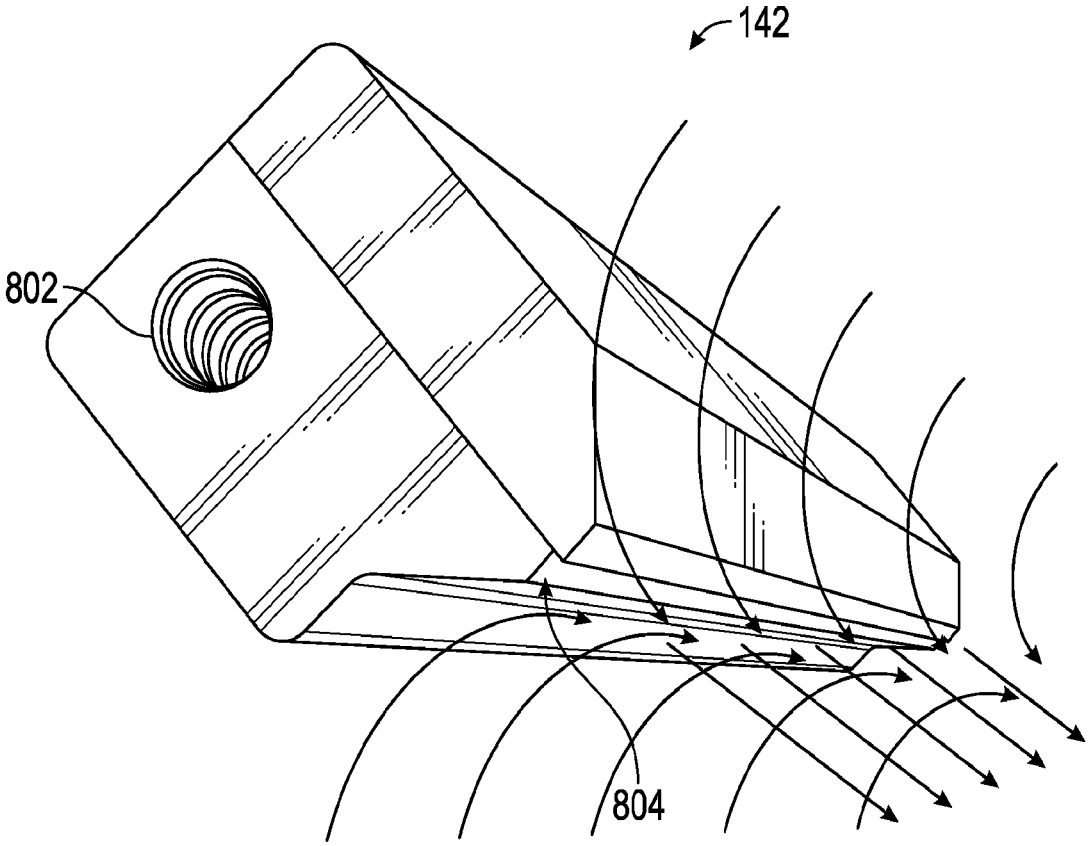
FIG. 6 is a perspective view of an embodiment of an air knife in accordance with embodiments disclosed herein.

In some embodiments, the pressure differential generator 142 may be an air knife, such as the Super Air Knife manufactured by Exair Corporation (Cincinnati, Ohio), as shown in FIG. 6. As understood in the field of fluid dynamics, a velocity of a motive fluid increases as the fluid passes through a constriction in accordance with the principle of continuity. Likewise, the pressure of the motive fluid must decrease in accordance with the principle of conservation of mechanical energy. As a result, gains in kinetic energy of the motive fluid associated with its increased velocity through a constriction may be negated by the commensurate drop in pressure. The air knife may draw a portion of the liquid or slurry (and surrounding air) through the screen 108 (FIG. 1) and may accelerate the portion of the drilling fluid to convey the drilling fluid. The air knife has an inlet 802 in which compressed air flows through. Within the air knife, the compressed air is directed to a precise, slotted orifice and exits a thin slotted, nozzle 804 creating a flat surface that directs the airflow in a substantially straight line. This creates a uniform sheet of air across the entire length of the air knife. Velocity loss is minimized and force is maximized as the portion of the liquid or slurry (and surrounding air) is entrained into the primary airstream at a ration ranging from about 30:1 to about 40:1. The air knife may be constructed from aluminum, stainless steel, composite and/or another material. In one or more embodiments, the pressure differential generator 142 may provide maintenance-free operation since the pressure differential generator 142 may have no moving parts and/or may not require electricity to operate and may reduce energy costs due to reduced compress air usage.

FIG. 4 illustrates a pressure differential generator 142 positioned below the tray 112, where the pressure differential generator 142 is an air knife. The fluid from the fluid source (not shown) may flow through a fluid inlet into a plenum chamber 300. The fluid from the fluid source may then flow through the nozzles 344. As a result, the fluid flowing into the nozzles 344 may generate fluid jets 346. The fluid jets 346 may entrain the portion of liquid from the drain port 116 creating the pressure differential across the screen 108. The pressure differential generator 142 may generate a pressure differential between a substantially full vacuum and a near zero vacuum depending on the fluid source. Any combination of vacuum and/or vacuum patterns (e.g., continuous, pulsed, variable, and/or progressive) may be applied consecutively, concurrently, and/or alternately.

In some embodiments, the pressure differential generator 142 may be an air amplifier, line vacuum, vacuum generator, blower or a device capable of generating a pressure differential by the use of fluid, such as by those that operate in accordance Bernoulli's principle, in particular the Venturi effect or the Coanda effect. The Venturi effect as used herein generally relates to increasing the velocity of the motive fluid provided from a fluid source from a decrease in cross-sectional area in the pressure differential generator 142. The Coanda effect as used herein generally relates to a stream of fluid attaching itself to a nearby surface and remaining attached even when the surface curves away from the initial jet direction.

Because the liquid from the screen and surrounding air exiting the pressure differential generator 142 is at a high velocity, the liquid from the screen and surrounding air mixture may exit the pressure differential generator 142 as a combination of a fluid and mist. In some embodiments, the high velocity drilling fluid mixture exiting the pressure differential generator 142 may be sent to the sump or a collection tank for collection.

Figure 7:
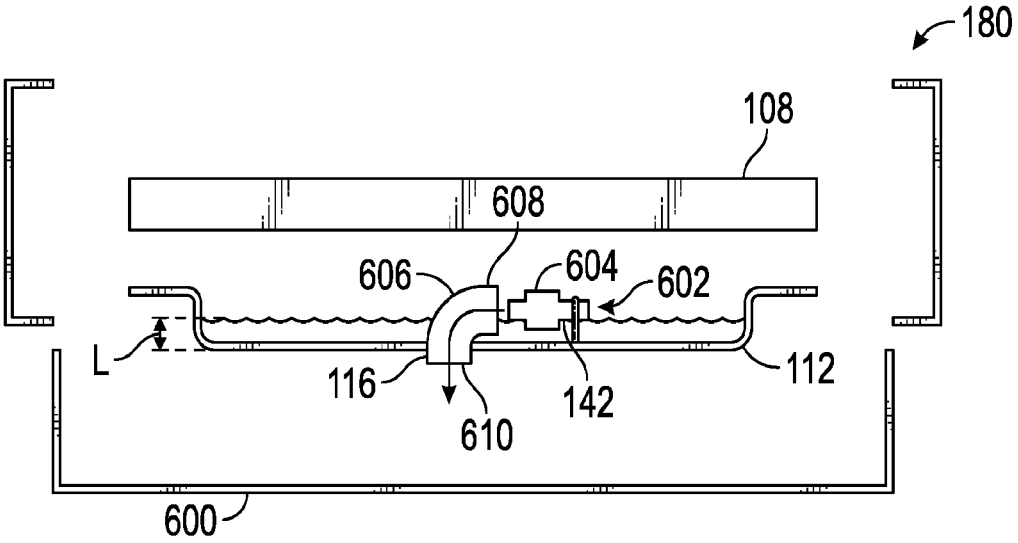
FIG. 7 is a schematic view of a vibratory separator in accordance with embodiments disclosed herein.

Referring to FIG. 7, a pressure differential generator 142 in accordance with one or more embodiments is shown. Like elements are represented by like reference numerals and such components may be interchangeable between example pressure differential systems. The pressure differential generator 142 may be coupled to the tray 112, such that an inlet 602 of the pressure differential generator 142 and outlet 604 of the pressure differential generator 142 are above the liquid level, L, of the tray 112. Within a drain port 116 of the tray 112, a receiver 606 may be placed, such that an inlet 608 of receiver 606 is substantially axially aligned and spaced a distance from the outlet 604 of the pressure differential generator 142. The inlet 608 of receiver 606 is also placed, such that a portion of the inlet 608 of receiver 606 is below the liquid level, L, of the tray 112. An outlet 610 of the receiver 606 is below the tray 112 and directs a mixture of entrained air and fluid to a sump 600. In some embodiments, the receiver 606 may be an elbow pipe. By axially aligning the inlet 608 of the receiver 606 and spacing the inlet 608 a distance from the outlet 604 of the pressure differential generator 142, an additional vacuum may be provided in addition to that generated by the pressure differential generator 142. The receiver 606 may channel the high velocity air from the pressure differential generator 142 to the sump 600 along with minimizing the misting of the mixture of entrained air and fluid to the sump 600.

Figure 8:
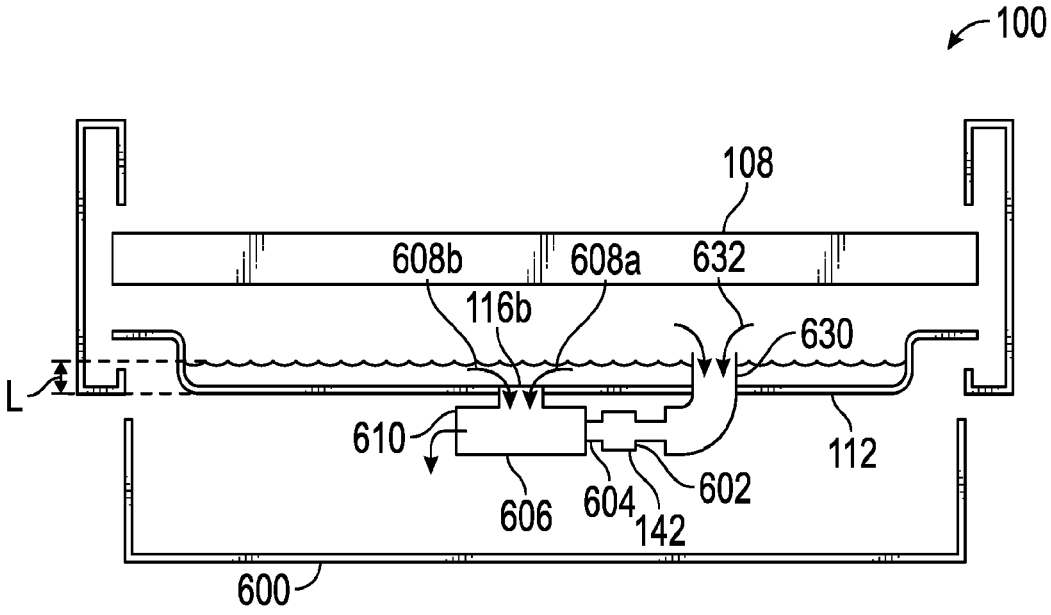
FIG. 8 is a schematic view of a vibratory separator in accordance with embodiments disclosed herein.

Referring to FIG. 8, a pressure differential generator 142 is shown in accordance with one or more embodiments. The inlet 602 of the pressure differential generator 142 may be coupled to an outlet 610 of a first receiver 630 that is coupled to a first drain port 116*a* of the tray 112. In some embodiments, the inlet 632 of the first receiver 630 is above the liquid level, L, of the tray 112. The outlet 604 of the pressure differential generator 142 may be coupled to an inlet 608*a* of a second receiver 606. In some embodiments, the second receiver 606 may be a T-joint, having the inlet 608*a* coupled to the outlet 604 of the pressure differential generator 142, a second outlet 608*b* coupled to a second drain port 116*b* of the tray 112, and an outlet 610 discharging to the sump 600. The second receiver 606 may channel the high velocity air from the pressure differential generator 142 to the sump 600 along with minimizing the misting of the mixture of entrained air and fluid to the sump 600.

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. A system comprising:

a separatory screen;

a separatory tray disposed below an underside of the separatory screen;

a pressure differential pan having two side regions, a first end region configured to allow fluid flow to a sump, and an inlet located on one of the side regions configured to allow fluid flow therethrough, the pressure differential pan coupled to the underside of the separatory tray; and a pressure differential generator located within the pressure differential pan, the pressure differential generator configured to create a pressure differential between an upper side and a lower side of the separatory screen to enhance the flow of drilling fluid wherein the pressure differential generator creates a uniform sheet of a gas along the length of the pressure differential generator within the pressure differential pan.

2. The system of claim 1, wherein a top surface of the two side regions of the pressure differential pan is coupled to a lower surface of the separatory tray.

3. The system of claim 1, wherein the pressure differential generator is an air knife.

4. The system of claim 3, wherein the air knife traverses the width of the pressure differential pan.

5. The system of claim 1, wherein the pressure differential generator is located proximate a drain port in the separatory tray.

6. The system of claim 5, wherein the pressure differential generator is located downstream of the drain port in the separatory tray.

7. The system of claim 1, further comprising a pressure differential device located external to the pressure differential pan and coupled to the pressure differential generator.

8. The system of claim 1, further comprising a vibratory separator including a basket therein; the separatory tray disposed in the basket.

9. The method of claim 8, further comprises a separating the mixture into entrained air, vapor and the drilling fluid in the sump.

10. The system of claim 3, wherein the inlet of the pressure differential pan is axially aligned to an inlet of the air knife to provide.

11. A system comprising:

a separatory screen;

a separatory tray coupled to an underside of the separatory screen;

a pressure differential generator coupled to the separatory tray, the pressure differential generator configured to create a pressure differential between an upper side and a lower side of the separatory screen to enhance the flow of drilling fluid through the separatory screen;

a sump in fluid communication with the separatory tray;

a first receiver located within a first drain port defined by the separatory tray and coupled to an inlet of the pressure differential generator; and a second receiver fluidly coupled to the pressure differential generator for minimizing misting of a mixture of entrained air and fluid from the separatory tray to the sump, wherein the second receiver includes a first inlet and a second inlet, the first inlet located within a second drain port defined by the separatory tray, and the second inlet coupled to an outlet of the pressure differential generator.

12. The system of claim 11, wherein the first inlet of the second receiver is below the liquid level in the separatory tray.

13. The system of claim 11, wherein an inlet of the first receiver is above a liquid level in the separatory tray.

14. The system of claim 11, wherein the pressure differential generator is an air amplifier, a line vacuum, or a vacuum generator.

15. A method comprising:

generating a pressure differential between an area above a screen and an area below the screen, thereby pulling a mixture of air and/or vapor and a drilling fluid through the screen and into a separatory tray; and conveying the mixture to a sump via a pressure differential pan coupled to an underside of the separatory tray, wherein the generating comprises creating a vacuum by flowing a fluid through a pressure differential generator located within the pressure differential pan.

16. The method of claim 15, wherein the pressure differential generator produces a substantially uniform linear flow of fluid across the pressure differential generator.

17. The method of claim 15, wherein the creating a vacuum may be continuous, pulsed, variable, and/or progressive.

* * * * *